US011110591B2

(12) United States Patent
Chen

(10) Patent No.: US 11,110,591 B2
(45) Date of Patent: Sep. 7, 2021

(54) DRAWER-TYPE TOOLBOX

(71) Applicant: Pei-Lin Chen, Taichung (TW)

(72) Inventor: Pei-Lin Chen, Taichung (TW)

( * ) Notice: Subject to any disclaimer, the term of this patent is extended or adjusted under 35 U.S.C. 154(b) by 0 days.

(21) Appl. No.: 17/030,548

(22) Filed: Sep. 24, 2020

(65) Prior Publication Data

US 2021/0178572 A1 Jun. 17, 2021

(30) Foreign Application Priority Data

Dec. 12, 2019 (TW) ..... 108145488

(51) Int. Cl.
*B25H 3/02* (2006.01)

(52) U.S. Cl.
CPC ..... *B25H 3/028* (2013.01)

(58) Field of Classification Search
CPC ..... B25H 3/02; B25H 3/028; B65D 85/00; A45C 11/00; A45C 13/10; A45C 13/1084
USPC ..... 206/372–373
See application file for complete search history.

(56) References Cited

U.S. PATENT DOCUMENTS

| | | | | |
|---|---|---|---|---|
| 3,301,619 | A * | 1/1967 | Mead | B25H 3/028 206/373 |
| 6,422,386 | B1 * | 7/2002 | Wiese | A45C 5/00 206/373 |
| 6,736,265 | B2 * | 5/2004 | Kipper | B25H 3/023 206/373 |
| 9,844,264 | B1 * | 12/2017 | Stewart, III | A47B 96/021 |
| 10,182,628 | B2 * | 1/2019 | Tonelli | A45C 5/03 |
| 10,920,467 | B2 * | 2/2021 | Richter | B25H 3/028 |
| 2009/0294310 | A1 * | 12/2009 | Franczyk | B25H 3/021 206/372 |

* cited by examiner

*Primary Examiner* — Bryon P Gehman

(57) ABSTRACT

A drawer-type toolbox has a box, a pivot, an axis and at least one buckle. The box has a box body, a cover and a drawer. The top surfaces of the cover and the box body are pivotally connected to each other, so they can be selectively opened or closed. The drawer is a storage space type, and some part of the drawer is accommodated in the box body, and the other part is covered with the cover. A slide rail is arranged between the drawer and the box body. When the box body, cover body and drawer are in close contact, an accommodation space is formed inside. The buckle is arranged on the cover surface and the corresponding position of the drawer, so as to lock the rotation limit of the closed state of the cover and limit the sliding state of the drawer at the same time.

8 Claims, 8 Drawing Sheets

DRAWER-TYPE TOOLBOX

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a toolbox, and more particularly to the innovative structure type of a drawer-type toolbox.

2. Description of Related Art Including Information Disclosed Under 37 CFR 1.97 and 37 CFR 1.98

The common toolboxes on the market are mostly tool cribs composed of a cover and a box body. This kind of toolbox is applicable to households for lightness and portability. For a simple repair, a wide range of tools is taken out of the toolbox for repair, so the tools loaded are applicable to general households for the toolbox space and use.

However, the known structure still has the following problems and defects in practical application. For example, for some professional repair and maintenance workers, the toolboxes on the market are designed well, but the tools are insufficient, so the professional toolboxes are still old-fashioned. Recently, the old-fashioned toolbox has been improved to form a foldable toolbox, the toolbox is opened progressively, but the inner space type of this toolbox still follows the inner space type of the old-fashioned toolbox, and the shelves are free of embedding grooves, the tools are likely to be damaged and lost.

BRIEF SUMMARY OF THE INVENTION

The main purpose of the invention is to provide a drawer-type toolbox, comprising: a box, at least a pivot, an axis and at least a buckle; said box comprises a box body, a cover and a drawer; said box body has a top surface and an abutting surface at the lateral opening; said cover has a top surface, a contact surface and a cover surface; said top surface of the cover and the top surface of the box body are pivotally connected to each other by the pivot, so that the cover and the box body can be optionally opened or closed; said drawer is of storage space type; a part of said drawer is accommodated in the box body, the other part of said drawer is covered with the cover; a slide rail is arranged between the drawer and the box body; said slide rail is arranged towards the axis; when the box body, the cover and the drawer are in close contact with each other, an accommodation space is formed inside; said buckle is disposed in the corresponding positions of the cover surface of the cover and the drawer, so as to lock the gyration of the cover in closed state, and to limit the sliding state of the drawer; when the contact surface of the cover clings to the abutting surface of the box body, the cover is in closed state; when the cover is turned up to open, the top surface of the cover is superposed on the top surface of the box body, the contact surface of the cover is vertically aligned with the abutting surface of the box body.

DETAILED DESCRIPTION OF THE INVENTION

Figure 1:
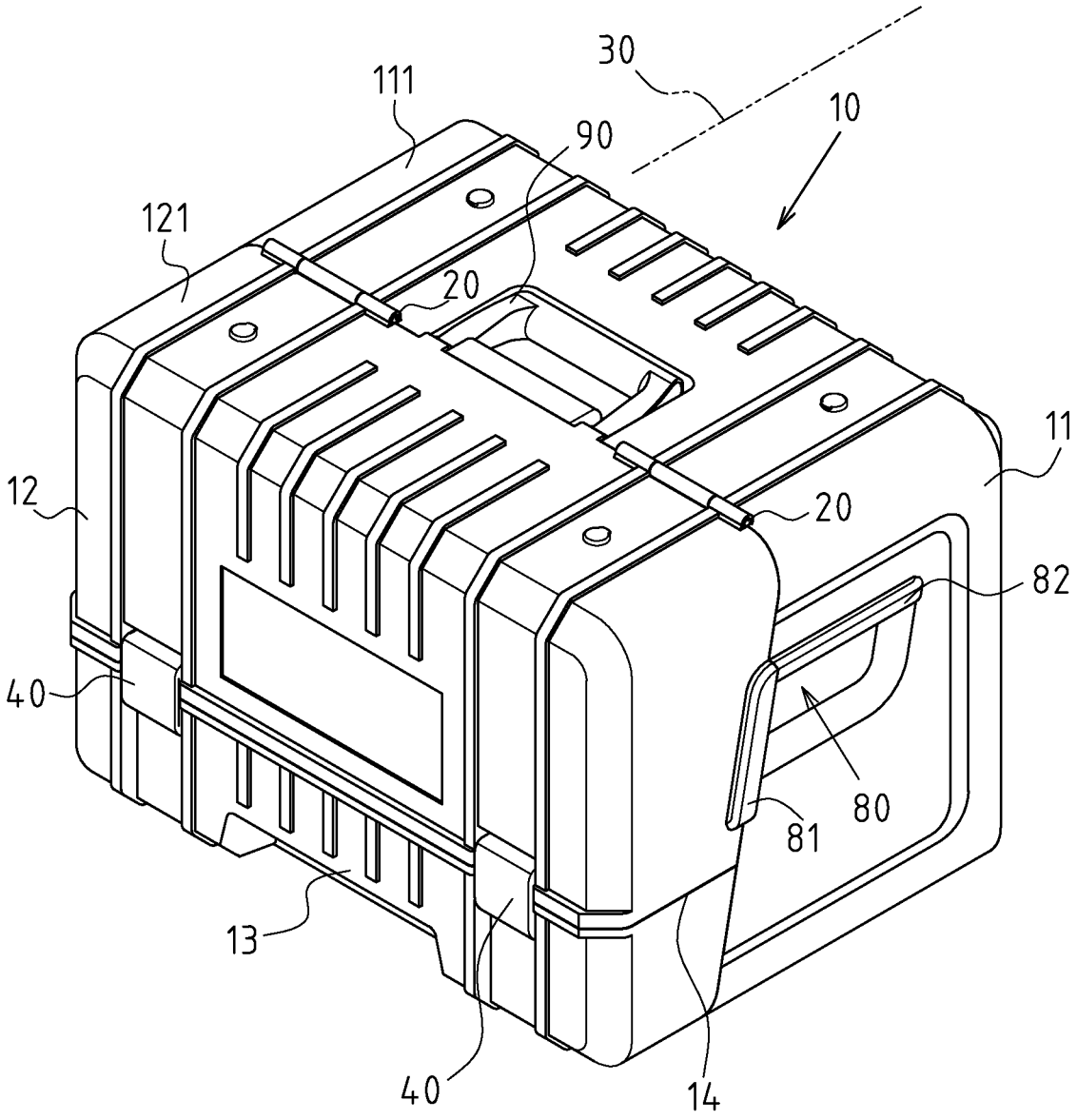
FIG. 1 is the combined stereogram of the preferred embodiment of the present invention.
Figure 2:
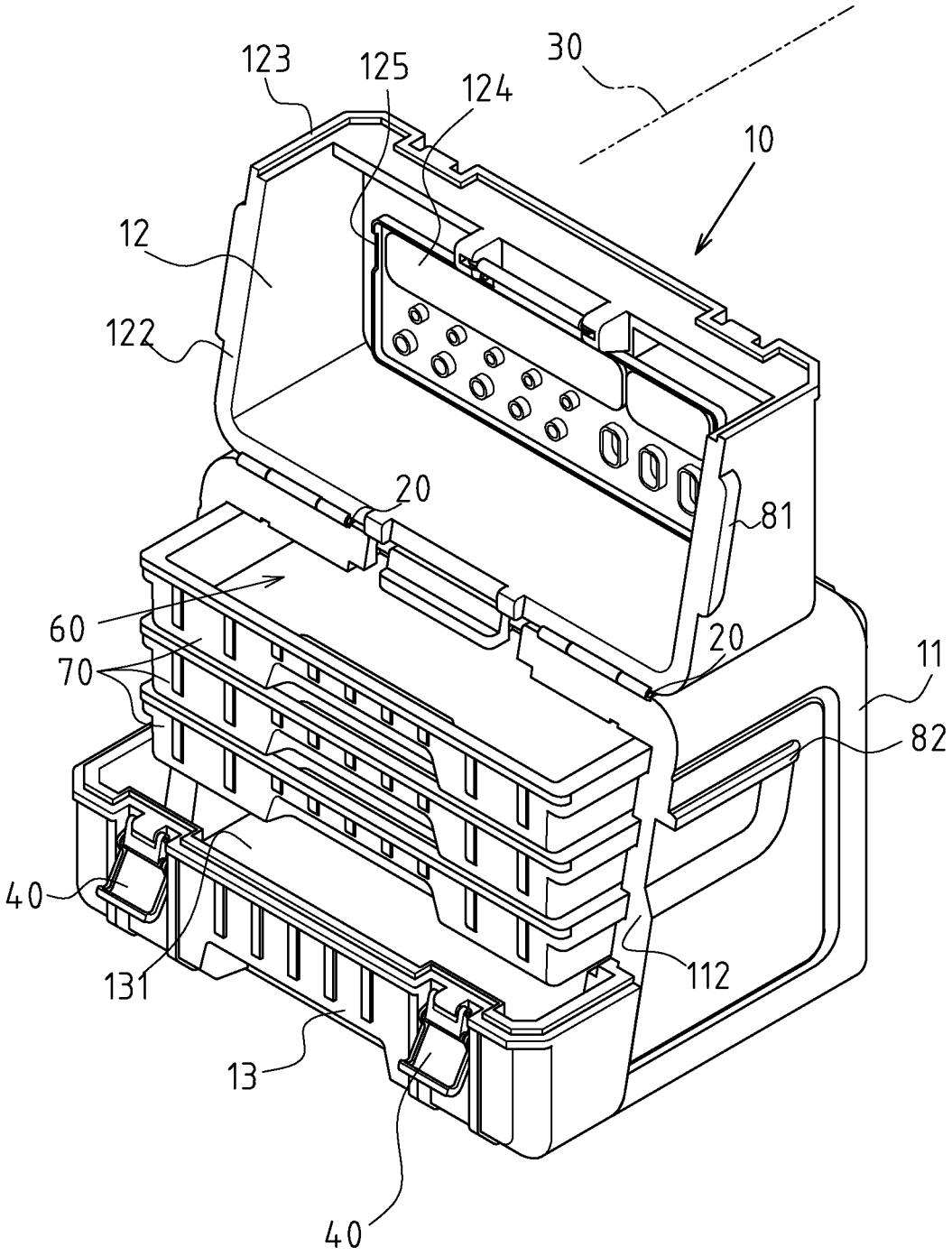
FIG. 2 is the stereogram of the cover opened of the present invention.

FIGS. 1 to 4 show the preferred embodiments of the drawer-type toolbox of the present invention, but the embodiments are for illustration only, the patent application is not limited to this structure.

Said drawer-type toolbox comprises a box 10, at least a pivot 20, an axis 30 and at least a buckle 40. The box 10 is composed of a box body 11, a cover 12 and a drawer 13. The box body 11 has a top surface 111 and an abutting surface 112 at the lateral opening. The cover 12 has a top surface 121, a contact surface 122 and a cover surface 123. The top surface 121 of the cover 12 and the top surface 111 of the box body 11 are pivotally connected to each other by the pivot 20, so that the cover 12 and the box body 11 can be optionally opened or closed. The drawer 13 is of storage space type. A part of the drawer 13 is accommodated in the box body 11, and the other part of the drawer 13 is covered with the cover 12. A slide rail 50 is arranged between the drawer 13 and the box body 11. The slide rail 50 is arranged towards the axis 30. When the box body 11, the cover 12 and the drawer 13 are in close contact with each other, an accommodation space 60 is formed inside. The accommodation space 60 is provided for placing at least one pull box 70. The buckle 40 is disposed in corresponding positions of the cover surface 123 of the cover 12 and the drawer 13, so as to lock the gyration of the cover 12 in closed state and to limit the sliding state of the drawer 13. When the contact surface 122 of the cover 12 clings to the abutting surface 112 of the box body 11, the cover 12 is in closed state. When the cover 12 is turned up, the top surface 121 of the cover 12 is superposed on the top surface 111 of the box body 11, and the contact surface 122 of the cover 12 and the abutting surface 112 of the box body 11 are vertically aligned.

A tool carrying plate 124 is pivoted inside the cover 12, the tool carrying plate 124 is provided with a concave span portion 125, the tool carrying plate 124 is upturned onto the cover 12, and the tool carrying plate 124 is superposed on the cover 12, so that the concave span portion 125 spans the cover surface 123 of the cover 12. A handle 80 is disposed on two opposite sides of the box 10 respectively. The handle 80 has a first segment 81 and a second segment 82. The first segment 81 is on the side of the cover 12, and the second segment 82 is on the side of the box body 11. When the cover 12 clings to the box body 11, the side of the first segment 81 towards the contact surface 122 of the cover 12 and the end face of the second segment 82 towards the abutting surface 112 of the box body 11 prop each other. When the cover 12 is turned over, the side of the first segment 81 towards the contact surface 122 of the cover 12 and the end face of the second segment 82 towards the abutting surface 112 of the box body 11 are on the same plane. A carrying handle 90 is disposed at the top of the box 10. The carrying handle 90 and the box 10 are on the same plane before use. The drawer 13 has a first storage part 131 and a second storage part 132. The first storage part 131 is provided with a contact surface 133. The length of the first storage part 131 corresponding to the extending direction of the pivot 20 is equal to the length of the bottom of the cover 12 corresponding to the extending direction of the pivot 20. The length of the second storage part 132 corresponding to the extending direction of the pivot 20 is shorter than the length of the box body 11 corresponding to the extending direction of the pivot 20 and accommodated in the bottom of the box body 11. The length of the second storage part 132 corresponding to the extending direction of the axis 30 is equal to the length of the bottom of the box body 11 corresponding to the extending direction of the axis 30, so that the contact surface 133 of the first storage part 131 clings to the abutting surface 112 of the box body 11.

Figure 3:
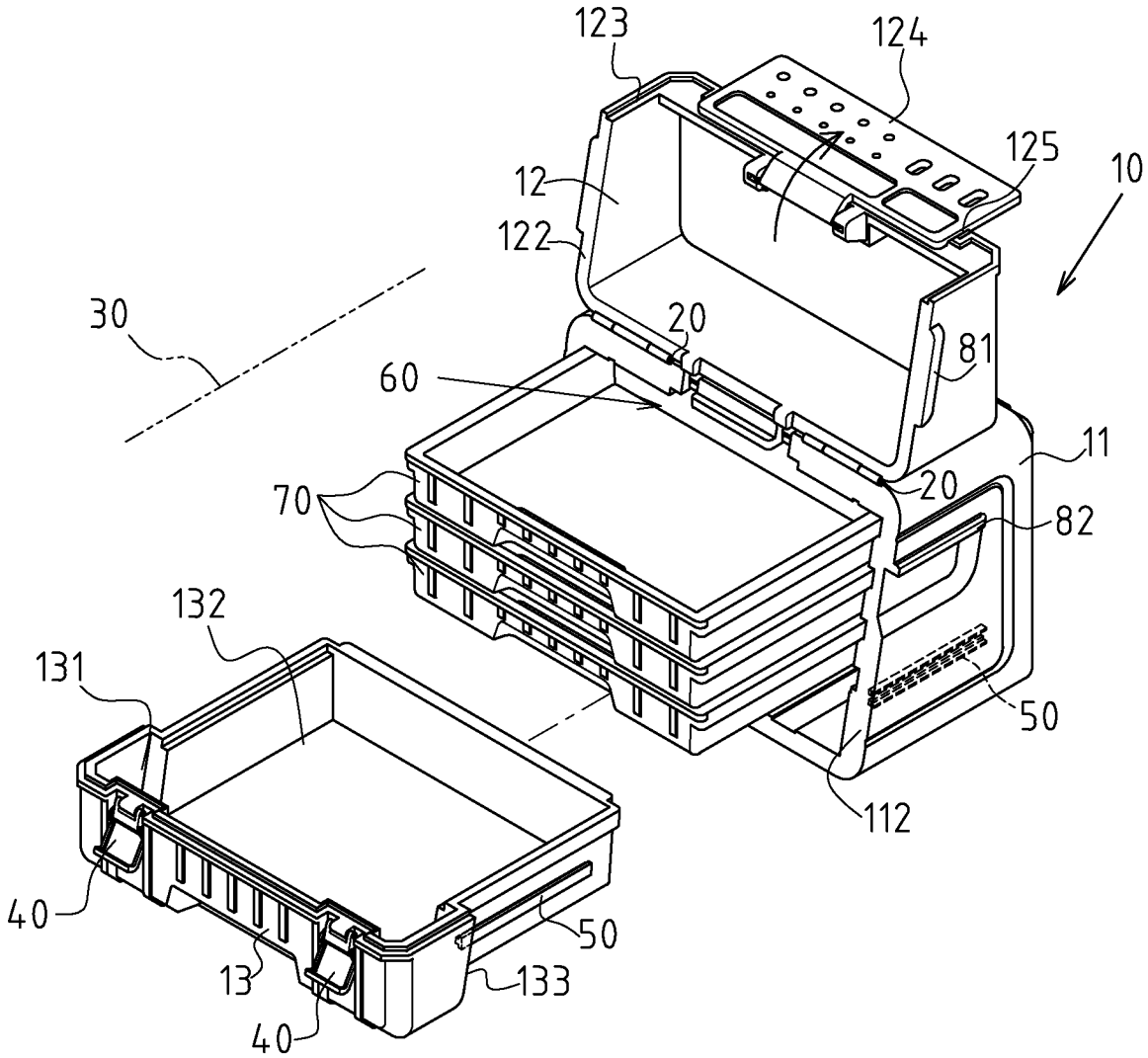
FIG. 3 is the exploded view of the preferred embodiment of the present invention.
Figure 4:
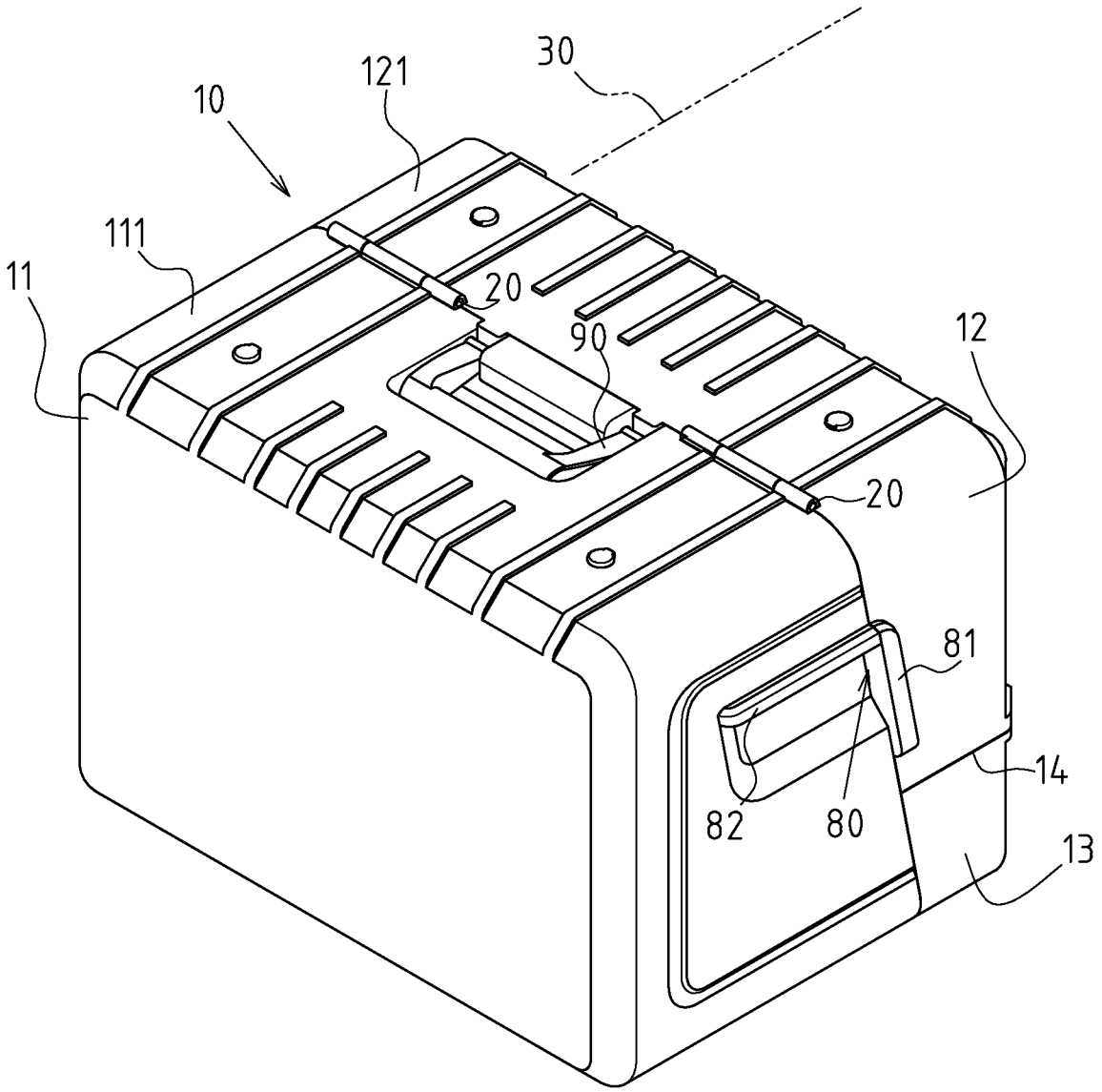
FIG. 4 is the rear view of the preferred embodiment of the present invention.

Based on the aforesaid structural composition type and technical characteristics, the practical application of the drawer-type toolbox disclosed in the present invention is shown in FIG. 3. The box 10 comprises the box body 11, the cover 12 and the drawer 13. The top surface 121 of the cover 12 and the top surface 111 of the box body 11 are pivotally connected to each other by the pivot 20, so that the cover 12 and the box body 11 can be optionally opened or closed. The drawer 13 is of storage space type, so that the drawer 13 can store tools. A part of the drawer 13 is accommodated in the box body 11, the other part is covered with the cover 12, and the drawer 13 is pulled or pushed against the box body 11 through the slide rail 50. When the box body 11, the cover 12 and the drawer 13 are in close contact with each other, the accommodation space 60 is formed inside. The accommodation space 60 is provided for placing the pull box 70. The buckle 40 is arranged in corresponding positions of the cover surface 123 of the cover 12 and the drawer 13, so as to lock the gyration of the cover 12 in closed state and to limit the sliding state of the drawer 13. When the contact surface 122 of the cover 12 clings to the abutting surface 112 of the box body 11, the cover 12 is in closed state, a space for storing tools is formed inside, and the buckle 40 limits the gyration of the cover 12 and the slide of the drawer 13. When the cover 12 is turned up, the top surface 121 of the cover 12 is superposed on the top surface 111 of the box body 11, the contact surface 122 of the cover 12 is vertically aligned with the abutting surface 112 of the box body 11, so that the drawer 13 and the pull box 70 can be pulled/pushed, and the user can take tools out. The box 10 of the present invention comprises the box body 11, the cover 12 and the drawer 13, it is convenient for the user to store tools and to take proper tools, the convenience is enhanced greatly.

Figure 5:
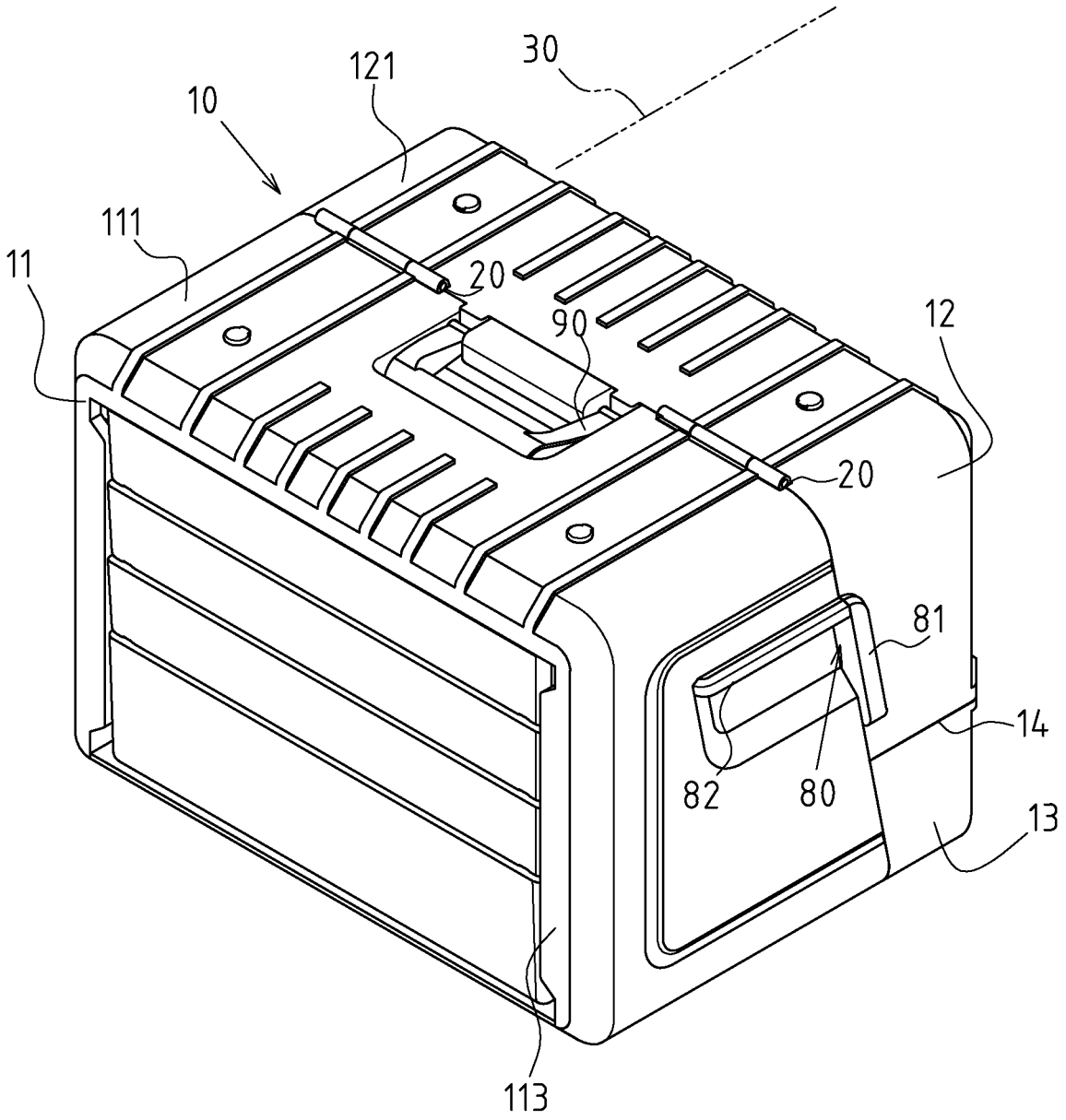
FIG. 5 shows the embodiment of limit part (1) of box body of the present invention.
Figure 6:
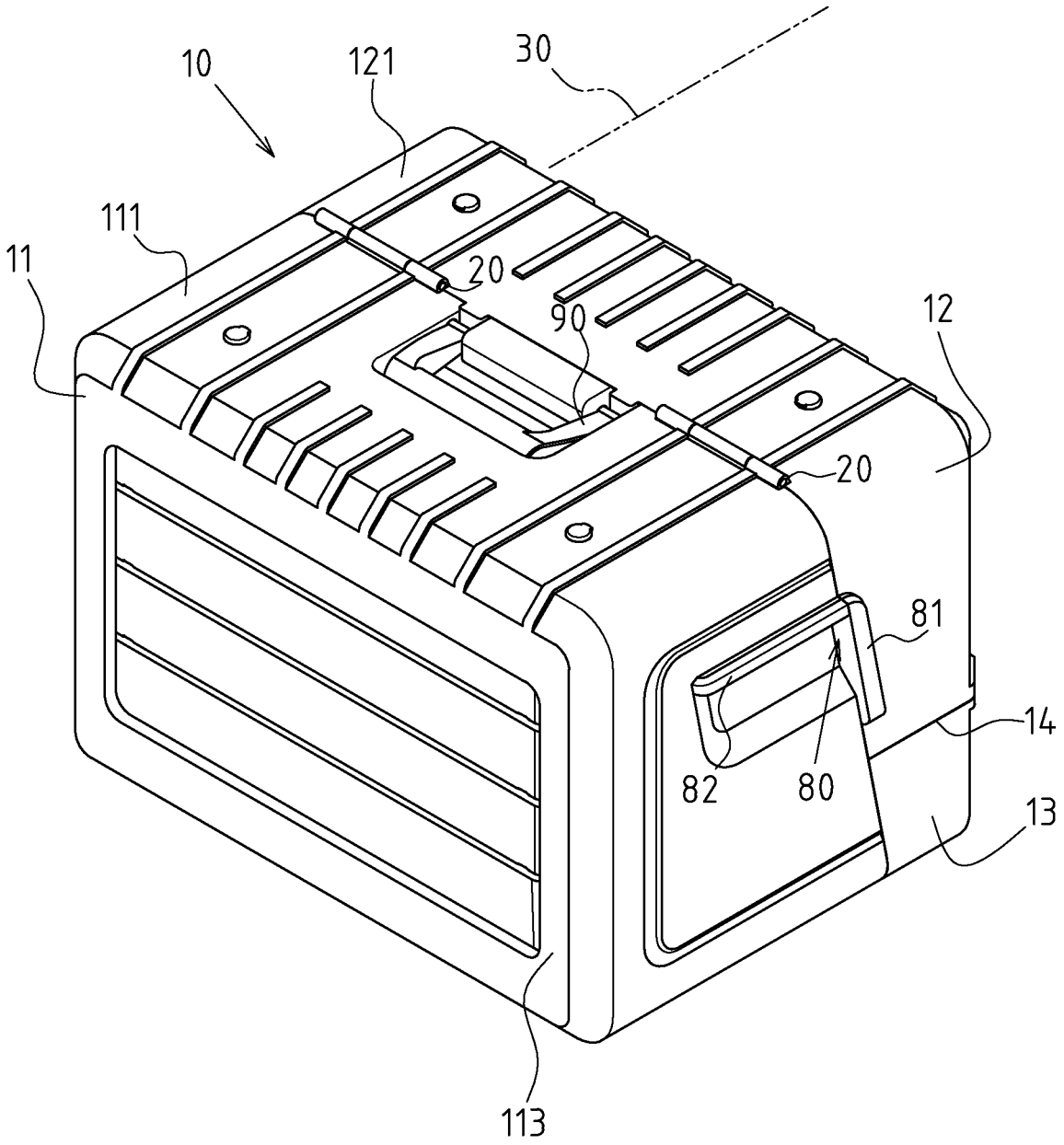
FIG. 6 shows the embodiment of limit part (2) of box body of the present invention.

As shown in FIGS. 5 and 6, in this embodiment, the opposite side of the box body 11 corresponding to the cover 12 is hollowed, a limit part 113 extends from the corresponding right and left sides (FIG. 5) or corresponding four sides (FIG. 6) of the box body 11 to the center of the box body 11. The limit part 113 stops the drawer 13 and pull box 70. This embodiment describes that due to different process methods, the back of the box body 11 is hollowed, but the drawer 13 and the pull box 70 must be prevented from departing from the box body 11, so the limit part 113 limits the drawer 13 and the pull box 70, the strength of the box body 11 is not influenced.

Figure 7:
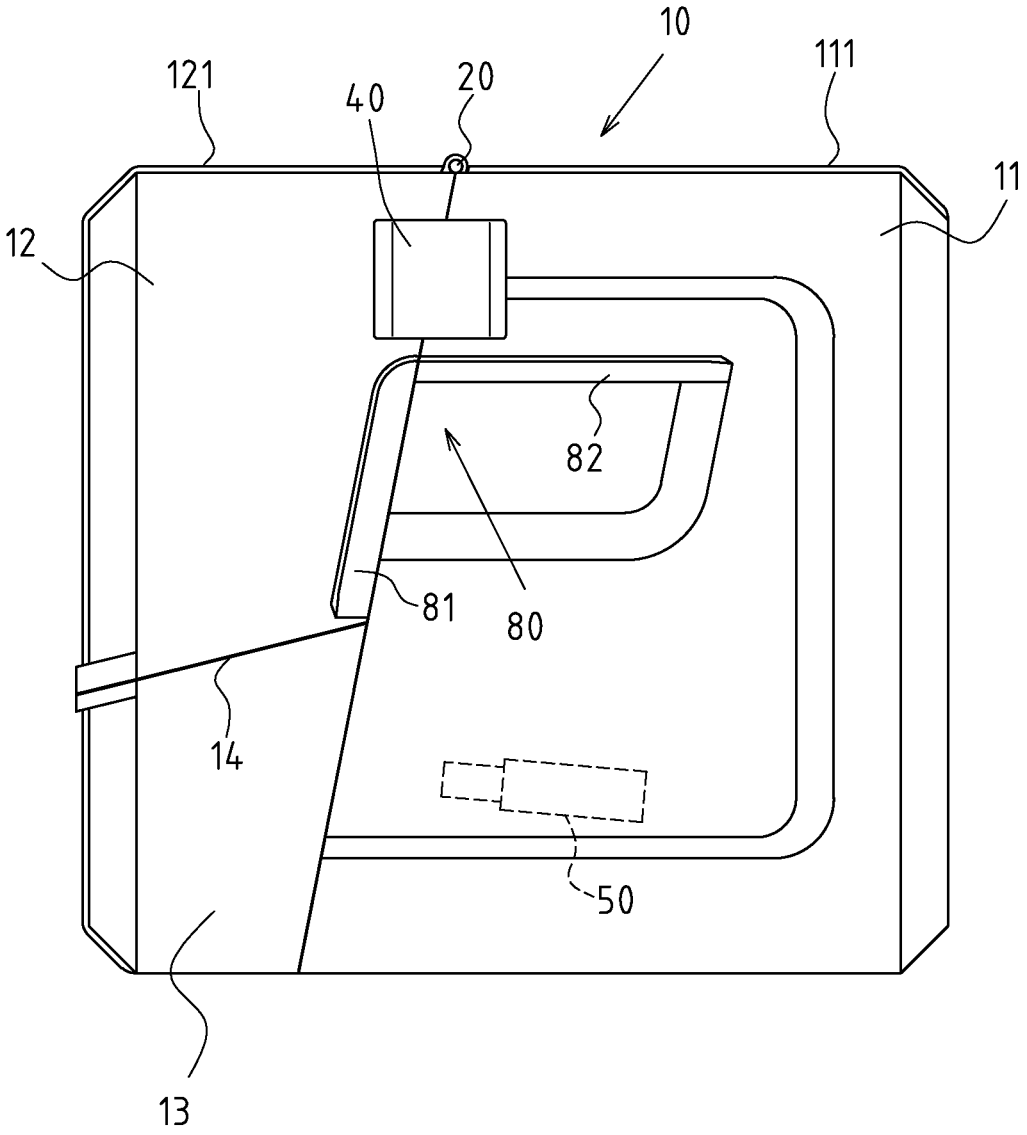
FIG. 7 is the side view of Embodiment 1 of the present invention.
Figure 8:
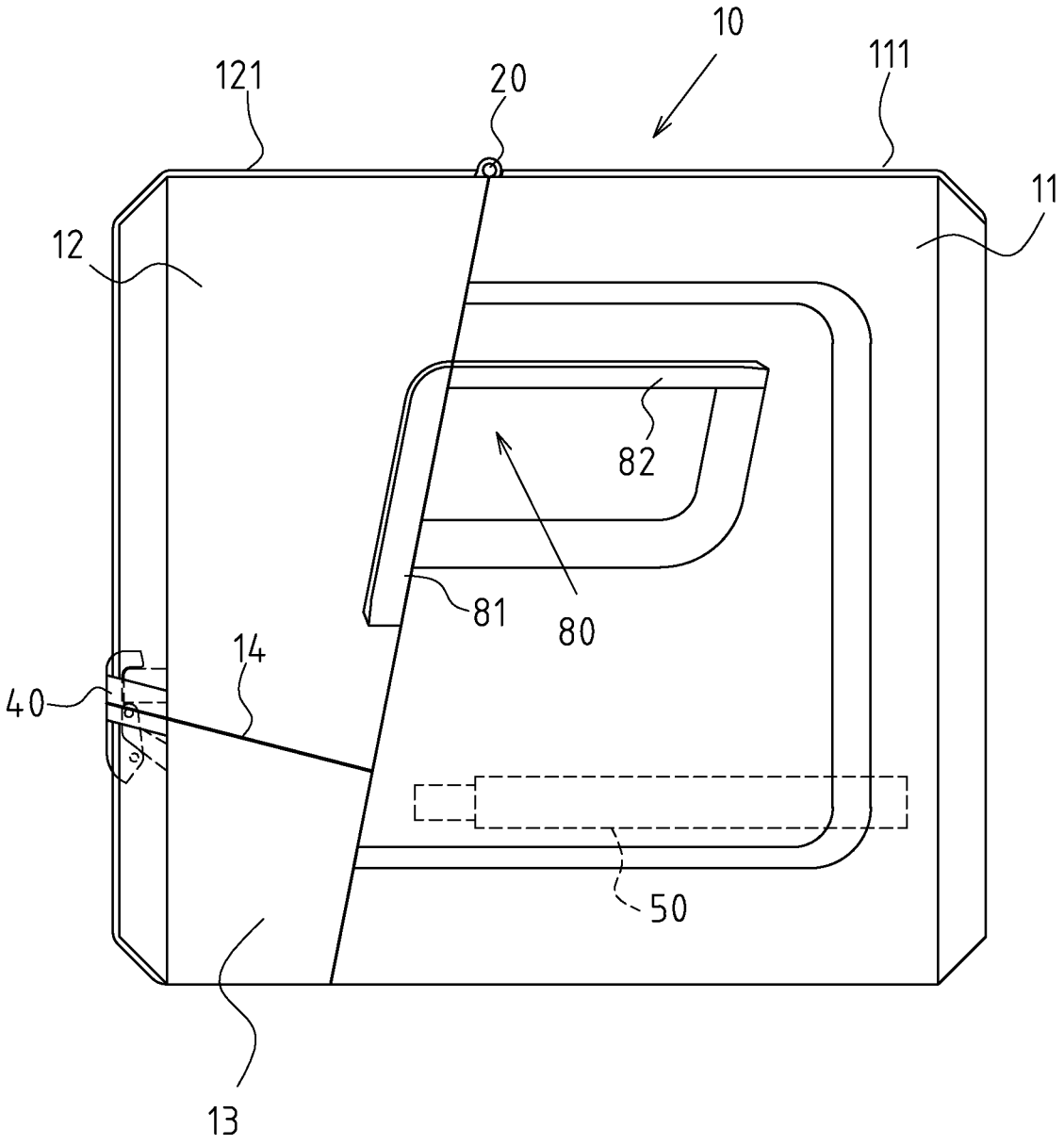
FIG. 8 is the side view of Embodiment 2 of the present invention.

As shown in FIGS. 7 and 8, in this embodiment, the buckle 40 limits the cover 12 and the box body 11 (FIG. 7), the cover 12 and the drawer 13 (FIG. 8) or the drawer 13 and the box body 11 (not shown in the figure); and the slide rail 50 can be tilted up (FIG. 7) or down (not shown in the figure).

As shown in FIG. 7, the buckle 40 is disposed in the corresponding positions of cover surface 123 of the cover 12 and the box body 11, so as to lock the cover 12 in closed state, and an auxiliary restraining structure limits the sliding state of the drawer 13.

As shown in FIG. 7, said auxiliary restraining structure is formed by tilting up the outer end of the slide rail 50, so that when the cover 12 is in closed state, the upward slide path of the drawer 13 is stopped by the cover 12 to achieve a restrictive effect.

As shown in FIG. 7, said auxiliary restraining structure is formed by tilting down the front end of the closing line 14 between the two sides of the cover 12 and the drawer 13 when the cover 12 is in closed state, so that the cover 12 in closed state has a restrictive effect on the forward transverse slide path of the drawer 13 (note: said auxiliary restraining structure is shown in FIG. 7, but one example is selected in reality, the auxiliary restrictive effect can be achieved).

Said auxiliary restraining structure can be formed by mounting at least a fastener between the cover 12 and the drawer 13, so as to simultaneously generate a restrictive effect on the cover 12 in closed state and the drawer 13 (note: not shown in the figure, the buckle 40 shown in FIG. 8 can be referred to, the structure type and function are the same as that stated in this paragraph).

I claim:

1. A toolbox comprising:

a box having a box body and a cover and a drawer, said box body having a top surface and an abutting surface at a lateral opening thereof, said cover having a top surface and a contact surface and a cover surface, the top surface of the cover and the top surface of the box body being pivotally connected to each other by a pivot, the cover being pivotally movable between an open position and a closed position relative to the box body, the drawer having a storage space therein, the box body receiving a portion of the drawer therein, another portion of the drawer being covered by the cover;

a slide rail arrangement arranged between the box body and the drawer, said slide rail arrangement extending to a face of the box body, the face of the box body bearing against a face of the cover when the cover is in the closed position, the drawer being slidably mounted in the slide rail arrangement; and a buckle being disposed on one of the cover surface of the cover and the drawer so as to engage with another of the cover surface of the cover and the drawer when the cover is in the closed position, the buckle releasably locking the cover in the closed position and restricting a sliding movement of the drawer, wherein the cover is in the closed position when the contact surface of the cover abuts the abutting surface of the box body, the top surface of the cover being superposed on the top surface of the box body and the contact surface of the cover being vertically aligned with the abutting surface of the box body when the cover is in the open position.

2. The toolbox of claim 1, wherein said box has an accommodation space therein, the accommodation space receiving a pull box therein.

3. The toolbox of claim 1, further comprising:

a tool-carrying plate pivotally mounted inside the cover, said tool-carrying plate having a concave span portion, wherein said tool-carrying plate is superposed on the cover and the concave span portion spans the cover surface of the cover when said tool-carrying plate is upturned on the cover.

4. The toolbox of claim 2, wherein a side of the box body corresponding to the cover is hollow, the toolbox further comprising:

a limit part extending from sides of the box body to a center of the box body, said limit part stopping a sliding movement of the drawer and the pull box.

5. The toolbox of claim 1, further comprising:

a handle being disposed on a side of the box body, said handle having a first segment and a second segment, the first segment being located on a side of the cover, the second segment being located on the side of the box body, a side of the first segment facing the contact surface of the cover and an end face of the second segment facing the abutting surface of the box body prop each other when the cover is in the closed position, the side of the first segment facing the contact surface of the cover and the end face of the second segment facing the abutting surface of the box body being in a common plane when the cover is in the open position.

6. The toolbox of claim 5, wherein the drawer has a first storage part and a second storage part, the first storage part having a contact surface, a length of the first storage part aligned with the pivot being equal to a length of a bottom of the cover aligned with the pivot, a length of the second storage part aligned with the pivot being shorter than a length of the box body aligned with the pivot.

7. A toolbox comprising:

a box having a box body and a cover and a drawer, said box body having a top surface and an abutting surface at a lateral opening thereof, said cover having a top surface and a contact surface and a cover surface, the top surface of the cover and the top surface of the box body being pivotally connected to each other by a pivot, the cover being pivotally movable between an open position and a closed position relative to the box body, the drawer having a storage space therein, the box body receiving a portion of the drawer therein, another portion of the drawer being covered by the cover;

a slide rail arrangement arranged between the box body and the drawer, said slide rail arrangement extending to a face of the box body, the face of the box body bearing against a face of the cover when the cover is in the closed position, the drawer being slidably mounted in the slide rail arrangement; and an auxiliary restraining structure formed by an upward tilt of an outer end of said slide rail, an upward slide path of the drawer being blocked by the cover when the cover is in the closed position, and restricting a sliding movement of the drawer.

8. A toolbox comprising:

a box having a box body and a cover and a drawer, said box body having a top surface and an abutting surface at a lateral opening thereof, said cover having a top surface and a contact surface and a cover surface, the top surface of the cover and the top surface of the box body being pivotally connected to each other by a pivot, the cover being pivotally movable between an open position and a closed position relative to the box body, the drawer having a storage space therein, the box body receiving a portion of the drawer therein, another portion of the drawer being covered by the cover;

a slide rail arrangement arranged between the box body and the drawer, said slide rail arrangement extending to a face of the box body, the face of the box body bearing against a face of the cover when the cover is in the closed position, the drawer being slidably mounted in the slide rail arrangement; and an auxiliary restraining structure formed by a downward tilt of a front end of a closing line formed between a pair of sides of the cover and the cover when the cover is in the closed position such that the cover restricts a forward slide path of the drawer when the cover is in the closed position, and restricting a sliding movement of the drawer.

* * * * *